United States Patent [19]

Bonotto

[11] Patent Number: 4,662,639

[45] Date of Patent: May 5, 1987

[54] GOLF TRAINING DEVICE

[76] Inventor: Albert Bonotto, 1849 Van Ness, Klamath Falls, Oreg. 97601

[21] Appl. No.: 793,768

[22] Filed: Nov. 1, 1985

[51] Int. Cl.[4] ..... A63B 69/36

[52] U.S. Cl. ..... 273/183 C; 273/200 R; 273/198; 273/184 B

[58] Field of Search ..... 273/411, 412, 413, 184 B, 273/200 R, 183 C, 185 C, 198, 200 A, 200 B

[56] References Cited

U.S. PATENT DOCUMENTS

| | | | |
|---|---|---|---|
| 1,555,124 | 9/1925 | Lambert | 273/185 C |
| 3,430,493 | 3/1969 | Wall, Sr. | 273/200 R |
| 4,125,230 | 11/1978 | Fischer | 273/184 B |

FOREIGN PATENT DOCUMENTS

| | | | |
|---|---|---|---|
| 2165956 | 7/1973 | Fed. Rep. of Germany | 273/414 |

*Primary Examiner*—George J. Marlo

*Attorney, Agent, or Firm*—Eugene M. Eckelman

[57] ABSTRACT

A body member arranged to lie flat on a golf practice area has a longitudinal passageway extending therethrough. An elongated tether line extends freely through the passageway and has a golf ball secured to each end. The line is substantially longer than the body member and the passageway is of a size to restrict a golf ball from moving therethrough whereby a golfer for the purpose of training hits the golf balls back and forth with the body member remaining stationary. The body member has sufficient mass to remain stationary as the line moves therethrough. The defining walls of the passageway are rounded to allow substantially friction free movement of the line therethrough.

4 Claims, 4 Drawing Figures

GOLF TRAINING DEVICE

BACKGROUND OF THE INVENTION

This invention relates to new and useful improvements in golf training devices.

Various devices have been developed in the past to aid golfers in their practice so that the golfer can develop the swing without an excessive amount of time on the golf course or on a golf practice range. One desirable feature in practice devices of this type is to give the golfer the same feel as striking a golf ball. Thus, the device should have provision for utilizing an actual golf ball in combination therewith. Another desirable feature is to be able to hit the golf ball either from a tee such as the type used when using a driver or from the grass itself such as when swinging fairway woods or irons. Yet another desirable feature is to employ a practice device that does not require the golfer to retrieve balls after the ball is hit. Further desirable features are to provide a golf practice device that is safe in its use, simplified in structure, and inexpensive to manufacture.

SUMMARY OF THE INVENTION

It is a primary objective of the present invention to provide a golf training device having all the above features and amounting in its over-all structure to a substantial improvement in the art.

More particularly, objects of the invention are to provide a golf training device that provides substantially the same feel as striking a ball on the golf course; it allows the golfer to hit the practice balls from a tee device or from the grass, it tethers a pair of balls in a novel manner so that the golfer does not have to retrieve the balls, it is safe in use, and is simplified and inexpensive to manufacture.

In carrying out these objectives, a flat body member is arranged to lie on a golf practice area and has a longitudinal passageway extending therethrough. An elongated tether line extends freely through this passageway and has a golf ball secured to each end. The tether line is substantially longer than the body member and the passageway is of a size to restrict a golf ball from passing therethrough whereby a golfer can alternately hit the golf balls back and forth with the body member remaining stationary on the golf practice area. The passageway is substantially wider than the tether line to allow the line to move freely therethrough in substantially a straight line. The side surfaces of the passageway are rounded to allow free and substantially friction free movement of the line through the passageway.

The invention will be better understood and additional objects and advantages will become apparent from the following description taken in connection with the accompanying drawings.

DETAILED DESCRIPTION OF A PREFERRED EMBODIMENT

Figure 1:
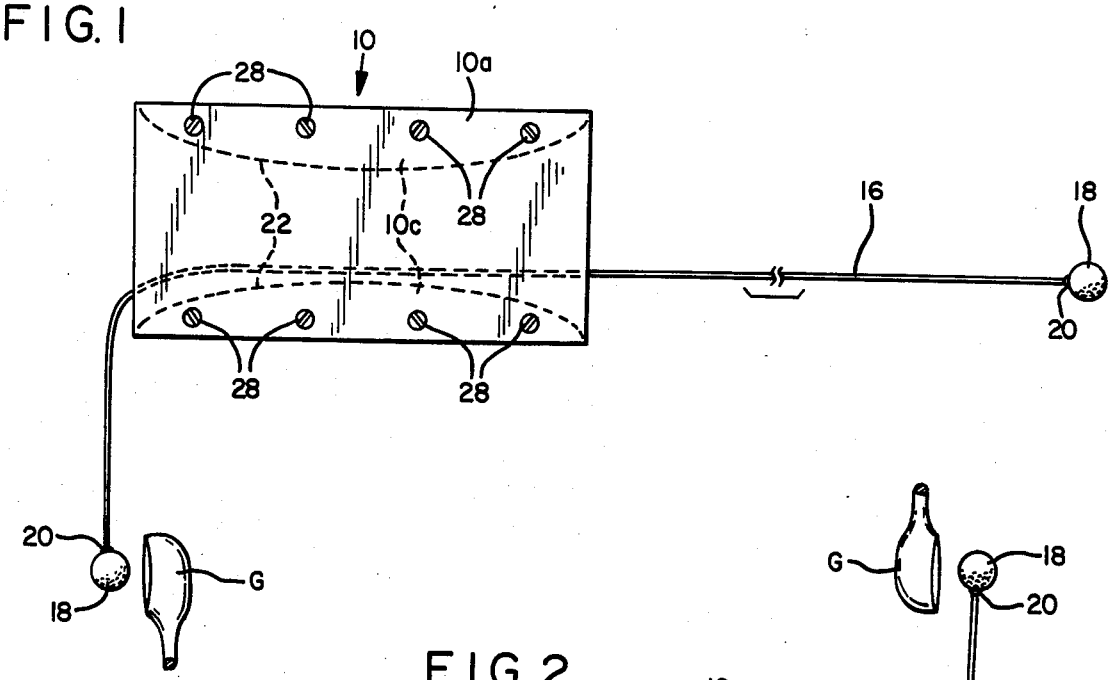
FIG. 1 is a top plan view of the present golf training device showing operation of a practice shot in one direction.
Figure 2:
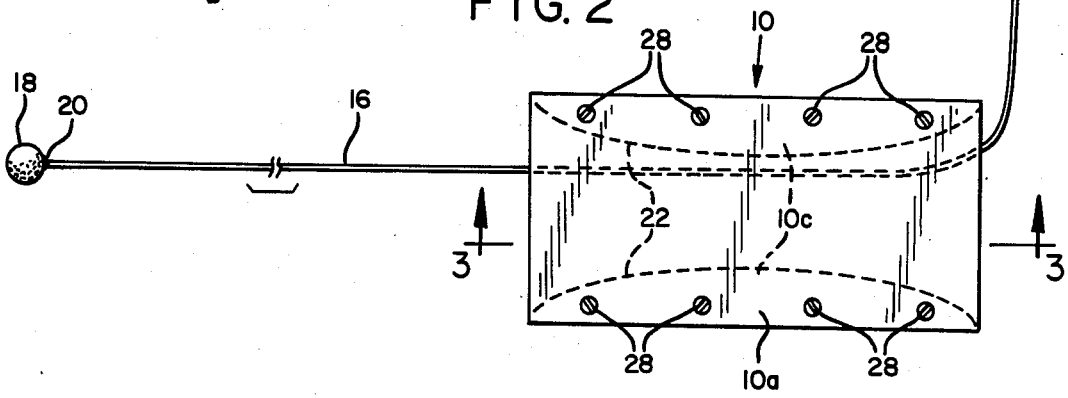
FIG. 2 is also a top plan view but showing the operation of a practice shot in the opposite direction.

With particular reference to the drawings, the present golf training device comprises a body member 10 having a low profile, flat configuration for the purpose of lying flat on a golf practice area. Although the device can assume various shapes, it is shown in plan as being rectangular with a flat bottom surface 12 for firm seated engagement on a golf practice surface.

The body member has a longitudinal passageway 14 therethrough arranged freely to receive a tether line 16 having a long distance, hard golf ball 18 secured to each end thereof. The golf balls are secured to the tether line in any suitable manner such as by screw and eye means 20 as shown or by direct molding of the line into the ball. The tether line is of greater length than the body member and more particularly is of a length such that a ball can be struck and will move to a distant point with the tether line being drawn through the body member in that direction.

Figure 3:
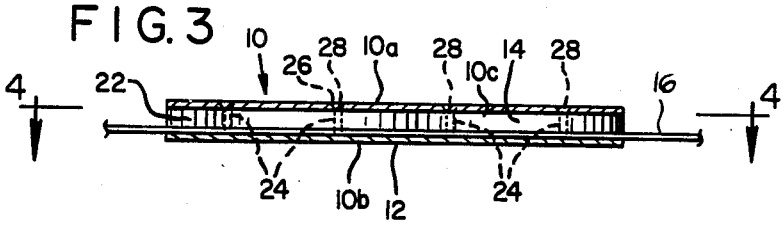
FIG. 3 is a vertical sectional view taken on the line 3—3 of FIG. 2.
Figure 4:
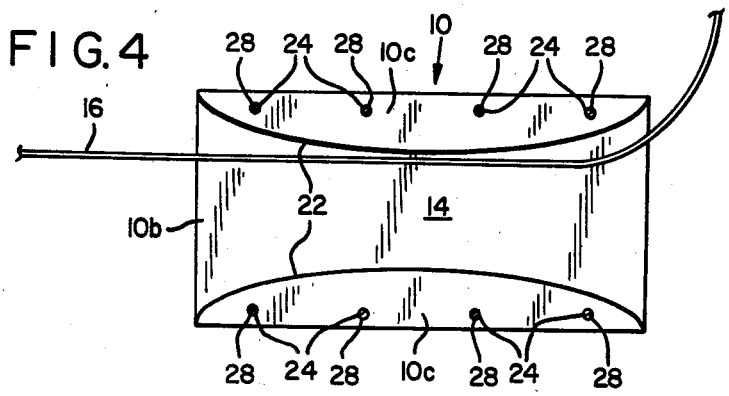
FIG. 4 is a sectional view taken on the line 4—4 of FIG. 3.

With particular reference to FIGS. 3 and 4, the passageway 14 has a height greater than the tether line so as to allow the line to move freely therethrough. The passageway also has a greater width for this same purpose. Also, the side surfaces 22 of the passageway are rounded to provide substantially friction free movement of the line therethrough. The height of the passageway is less than the diameter of a golf ball so as to restrict movement of the ball therethrough.

In the operation of the training device, one of the golf balls at a short end of the tether line, FIG. 1, is struck by a golf club G. That is, the tether line is positioned with relation to the body member so as to have a shortened end and an elongated end. The short end of the tether line is brought to one side of the body member so that the ball can be struck in a direction parallel with the longitudinal dimension of the body member. When the ball is struck, the line moves with of the ball and draws the other ball up to or toward the body member. Thereupon, the golfer steps to the other side of the device and positions such other ball for driving it and the tether assembly in the opposite direction. The mass of the body member is such that in the movement of the line through it, or engagement thereby of a ball at the trailing end of the line, such body member will not move any substantial amount.

According to the present invention, a golfer when practicing does not have to retrieve golf balls. It is merely necessary to step from one side of the device to the other for striking the ball alternately back and forth. Since the balls used are regular golf balls, the "feel" of golf exists. The ball can be teed up or it can be hit from grass to further obtain the "feel" of regular golf. The substantially friction free movement of the line through the body member as well as the widened passageway and the rounded corners 22 allows the line to move straight through without any whipping action.

The device is simplified in structure and inexpensive to manufacture, namely, it may comprise a simple molded product. In a preferred form, the bottom wall 10*b* and spacers 10*c* are molded in one piece. A plurality of holes 24 in the spacers are tapped for receiving screws. The top 10*a* has a plurality of bores 26 aligned with the tapped holes 24 for providing releasable connection to the bottom wall by screws 28. The removable top wall allows for replacement or repair of the tether line unit.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A golf training device comprising a body member having one surface thereof arranged to support said device on a golf practice area, a longitudinal passageway extending through said body member having end openings, an elongated tether line extending freely through said passageway, and a long distance, hard golf ball secured to each end of said line, said line being substantially longer than said body member and said passageway being of a size to restrict a golf ball from moving therethrough whereby a golfer, for the purpose of training, hits said golf balls back and forth with said body member remaining stationary on the practice area and said tether line confined in said passageway.

2. The golf training device of claim 1 wherein said one surface comprises a flat bottom portion for supporting said device flat and unattached on the golf practice area, said body member having sufficient mass so as to remain stationary when a ball is struck and when said tether line moves in one direction and brings the other ball to a hitting position adjacent said body member.

3. The golf practice device of claim 1 wherein said passageway is substantially wider than said tether line to allow said line to move freely therethrough and in substantially a straight line without whipping.

4. The golf training device of claim 3 wherein defining walls of said passageway are rounded to allow substantially friction free movement of said tether line through said passageway.

* * * * *